US012628995B2

(12) United States Patent
VanTongeren

(10) Patent No.: US 12,628,995 B2
(45) Date of Patent: May 19, 2026

(54) HEIGHT ADJUSTABLE SELF-BALANCING AUTONOMOUS FLOOR CLEANER

(71) Applicant: BISSELL Inc., Grand Rapids, MI (US)

(72) Inventor: Todd R. VanTongeren, Ada, MI (US)

(73) Assignee: BISSELL, Inc., Grand Rapids, MI (US)

( * ) Notice: Subject to any disclaimer, the term of this patent is extended or adjusted under 35 U.S.C. 154(b) by 366 days.

(21) Appl. No.: 18/457,612

(22) Filed: Aug. 29, 2023

(65) Prior Publication Data

US 2024/0099531 A1 Mar. 28, 2024

Related U.S. Application Data

(60) Provisional application No. 63/410,032, filed on Sep. 26, 2022.

(51) Int. Cl.

| | |
|---|---|
| ***A47L 9/28*** | (2006.01) |
| ***A47L 9/00*** | (2006.01) |
| ***A47L 9/04*** | (2006.01) |
| ***A47L 11/40*** | (2006.01) |

(52) U.S. Cl.

CPC ..... *A47L 9/2852* (2013.01); *A47L 9/009* (2013.01); *A47L 9/0494* (2013.01); *A47L 9/2826* (2013.01); *A47L 11/4011* (2013.01); *A47L 11/4058* (2013.01); *A47L 11/4066* (2013.01); *A47L 11/4072* (2013.01); *A47L 2201/04* (2013.01); *A47L 2201/06* (2013.01)

(58) Field of Classification Search

CPC ..... A47L 9/2852; A47L 9/009; A47L 9/0494; A47L 9/2826; A47L 11/4011; A47L 11/4058; A47L 11/4066; A47L 11/4072; A47L 2201/04; A47L 2201/06

See application file for complete search history.

(56) References Cited

U.S. PATENT DOCUMENTS

| | | | | |
|---|---|---|---|---|
| 7,004,269 | B2 * | 2/2006 | Song | A47L 9/009 180/6.5 |
| 7,673,367 | B2 * | 3/2010 | Kim | A47L 9/02 15/354 |
| 9,282,867 | B2 | 3/2016 | Williams et al. | |
| 9,314,141 | B2 * | 4/2016 | Lee | A47L 11/24 |
| 10,045,675 | B2 * | 8/2018 | Haegermarck | A47L 11/4038 |
| 10,716,446 | B2 * | 7/2020 | Isenberg | A47L 11/4011 |
| 10,874,275 | B2 * | 12/2020 | Liggett | A47L 9/2805 |
| 11,129,512 | B2 | 9/2021 | Weigel et al. | |
| 11,213,180 | B2 | 1/2022 | Brown | |
| D1,019,029 | S * | 3/2024 | Zhou | D32/21 |

(Continued)

FOREIGN PATENT DOCUMENTS

| | | |
|---|---|---|
| CN | 111265155 A | 6/2020 |
| CN | 111297267 A | 6/2020 |

(Continued)

*Primary Examiner* — Toan C To

(74) *Attorney, Agent, or Firm* — Quinn IP Law

(57) ABSTRACT

An autonomous surface cleaner for cleaning a floor or other surface. The cleaner may include a body, a cleaning implement for cleaning a surface, a motorized drive system, a pair of wheels operable with the motorized drive system to assist moving the body relative to the surface, one or more actuators operable for controllably adjusting a height of the body, and/or a balancing system operable to self-balance the body.

21 Claims, 7 Drawing Sheets

(56) References Cited

U.S. PATENT DOCUMENTS

| | | | | |
|---|---|---|---|---|
| 2005/0166356 | A1* | 8/2005 | Uehigashi | A47L 11/4038 15/319 |
| 2014/0130294 | A1* | 5/2014 | Li | A47L 9/0488 15/372 |
| 2018/0317724 | A1* | 11/2018 | Cheung | A47L 9/1409 |
| 2019/0290089 | A1 | 9/2019 | Johnson et al. | |
| 2020/0196817 | A1 | 6/2020 | Fang | |
| 2020/0337513 | A1 | 10/2020 | Johnson et al. | |
| 2021/0022574 | A1* | 1/2021 | Harting | A47L 9/0488 |
| 2021/0068524 | A1 | 3/2021 | VanTongeren | |
| 2022/0079400 | A1 | 3/2022 | Wang et al. | |
| 2023/0248194 | A1* | 8/2023 | Han | A47L 11/4072 15/319 |
| 2023/0248201 | A1* | 8/2023 | Cox | A47L 11/4063 15/49.1 |
| 2023/0329505 | A1* | 10/2023 | VanTongeren | A47L 11/4058 |
| 2024/0302839 | A1* | 9/2024 | Lien | G05D 1/2246 |
| 2024/0310851 | A1* | 9/2024 | Ebrahimi Afrouzi | G01S 17/87 |
| 2024/0329660 | A1* | 10/2024 | Ryu | A47L 11/4066 |
| 2025/0089958 | A1* | 3/2025 | Ohm | A47L 9/2852 |
| 2025/0185867 | A1* | 6/2025 | Gao | G05D 1/628 |

FOREIGN PATENT DOCUMENTS

| | | | | |
|---|---|---|---|---|
| CN | 112353312 | A | 2/2021 | |
| CN | 112826376 | A | 5/2021 | |
| DE | 202023104662 | U1 * | 11/2023 | A47L 11/4047 |
| WO | 2021170979 | A1 | 9/2021 | |

* cited by examiner

HEIGHT ADJUSTABLE SELF-BALANCING AUTONOMOUS FLOOR CLEANER

CROSS-REFERENCE TO RELATED APPLICATIONS

This application claims the benefit of U.S. Provisional Application No. 63/410,032, filed Sep. 26, 2022, which is hereby incorporated by reference in its entirety.

TECHNICAL FIELD

The present disclosure relates to autonomous floor cleaners, such as but not necessarily limited to height adjustable, self-balancing autonomous floor cleaners capable of selectively adjusting a height and/or a balance of the cleaner.

BACKGROUND

An autonomous cleaner may include a suction nozzle, a mop, or another type of autonomously operable cleaning implement to clean a surface. An autonomously controlled drive mechanism may be coupled with the cleaner to facilitate moving the cleaning implement relative to the surface being cleaned, which in the case of an autonomous floor cleaner may be a floor or other terrain that the cleaner is traveling upon. The cleaner may be autonomously operable with a docking station to facilitate automatically recharging batteries, emptying recovery tanks, refilling supply tanks, switching cleaning implements, and otherwise assisting the cleaner with attending to onboard systems. Aside from the cleaner being dependent on a human operator to perform some minor tasks, like plugging the docking station into a power supply, filling/emptying reservoirs of the docking station, etc., an autonomous floor cleaner may essentially perform its cleaning functions without direct assistance from a human operator.

An autonomous floor cleaner may be designed to clean a room, for instance, by moving itself around the room until the cleaning implement has cleaned each area of interest, which may be dependent on the type of cleaning implement being used. An immovable cleaning implement, for example, may require the cleaner to crisscross all points of the room whereas a movable cleaning implement may instead require the cleaner to crisscross less than all points due to the cleaning implement itself being separately moveable. Autonomous floor cleaners may include wheels, tracks, or other motive elements operable to move upon the surface to be cleaned and to offset a body or other structure of the cleaner from the surface. The ability of such an autonomous cleaner to move around a room may be limited to a clearance between an underside of the cleaner and the floor or other surface being travelled upon. The clearance can prevent the cleaner from traveling over obstacles, objects, implements, and other navigation constraints due to an inability of the cleaner to ride over the obstacle.

Navigational systems can be included onboard the cleaner to help with avoiding and moving around obstacles, however, these autonomous types of navigation solutions may be insufficient in situations where it may be desirable or required for the cleaner to traverse over an obstacle that exceeds the clear space beneath the cleaner, or if the obstacle can fit at least partially underneath, doing so in a manner that avoids damaging or scraping the cleaner, e.g., that avoids physically dragging part of the cleaner over the obstacle and/or that avoids dragging a mop or other cleaning implement over carpeting or a sensitive surface where contact with the cleaning implement may be undesirable.

BRIEF SUMMARY

One non-limiting aspect of the present disclosure relates to an autonomous floor cleaner. The autonomous floor cleaner may include a body, cleaning implement, motorized drive system configured for autonomously moving the body relative to the floor surface, a plurality of wheels operable with the motorized drive system, and one or more actuators configured for controllably raising and lowering the body to selectively adjust a clearance between the body and the floor surface.

The autonomous floor cleaner may include a balancing system operable to self-balance the body.

The balancing system may generate a balancing force to self-balance the body.

The balancing system may include a gyroscopic flywheel operable to generate the balancing force.

The balancing system may include a reaction wheel operable to generate the balancing force.

The balancing system may include moveable mass assembly operable to generate the balancing force.

The balancing force may adjust a center of gravity of the body to align with a center of balance for the wheels.

The actuators may pivot the wheels relative to a pivot coupling included on the body, the clearance decreasing as the wheels pivot upwardly and increasing as the wheels pivot downwardly.

The actuators may telescope a linkage used to interconnect the wheels with the body, optionally with the clearance decreasing as the linkage telescopes inwardly and increasing as the linkage telescopes outwardly.

The actuators may telescope and pivot a linkage used to interconnect the wheels with the body, optionally with the clearance decreasing as the linkage telescopes inwardly, increasing as the linkage telescopes outwardly, decreasing as the wheels pivot upwardly, and increasing as the wheels pivot downwardly.

The autonomous floor cleaner may include a controller to autonomously control the motorized drive system and the actuators. The controller may adjust the clearance to a hover height in response to detecting an obstacle protruding above the floor surface so that the hover height may position the body above the obstacle.

The controller may adjust the clearance to a cleaning height in response to surpassing the obstacle, the cleaning height being lower than the hover height and below a top of the obstacle.

One non-limiting aspect of the present disclosure relates to an autonomous surface cleaner. The autonomous surface cleaner may include a body, a cleaning implement configured for cleaning a surface, a motorized drive system configured for autonomously moving the body relative to the surface, one or more actuators configured for controllably actuating the body between at least a first height and a second height, and a balancing system configured for generating a balance force to selectively influence a center of gravity for the body.

The autonomous surface cleaner may include a plurality of wheels operable with the motorized drive system and a controller operable to autonomously control the motorized drive system, the actuators, and the balancing system. The controller may control the balancing system to manipulate the balance force such that the center of gravity is forward of the wheels when the body is at the first height and is aligned with the wheels to self-balance the body when the body is at the second height.

The autonomous surface cleaner may include a rotatable caster extending from an underside of the body forwardly of the wheels that engages the surface when the body is at the first height and disengages the surface when the body is at the second height.

One non-limiting aspect of the present disclosure relates to an autonomous surface cleaner. The autonomous surface cleaner may include a body, a cleaning implement configured for cleaning a surface, a motorized drive system configured for autonomously moving the body relative to the surface, a plurality of wheels operable with the motorized drive system, a balancing system configured for generating a balance force to selectively influence a center of gravity for the body, and a controller operable to autonomously control the motorized drive system and the balancing system to self-balance the body over the wheels.

The autonomous surface cleaner may include one or more actuators operable to selectively adjust a height of the body between at least a first height and a second height.

The controller may be operable to control the balancing system such that the center of gravity is forward of the wheels when the body is at the first height and self-balanced over the wheels when the body is as the second height.

The body may include a rotatable caster forward of the wheels, optionally with the caster contacting the surface when the body is at the first height and raising above the surface when the body is at the second height.

The actuators may selectively adjust the height from the first height to the second height by pivoting linkages attached to the wheels downwardly and/or telescoping the linkages outwardly relative to the first height.

BRIEF DESCRIPTION OF THE DRAWINGS

The accompanying drawings, which are incorporated into and constitute a part of this specification, illustrate implementations of the disclosure and together with the description, serve to explain the principles of the disclosure.

DETAILED DESCRIPTION

While detailed embodiments of the present disclosure are disclosed herein, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
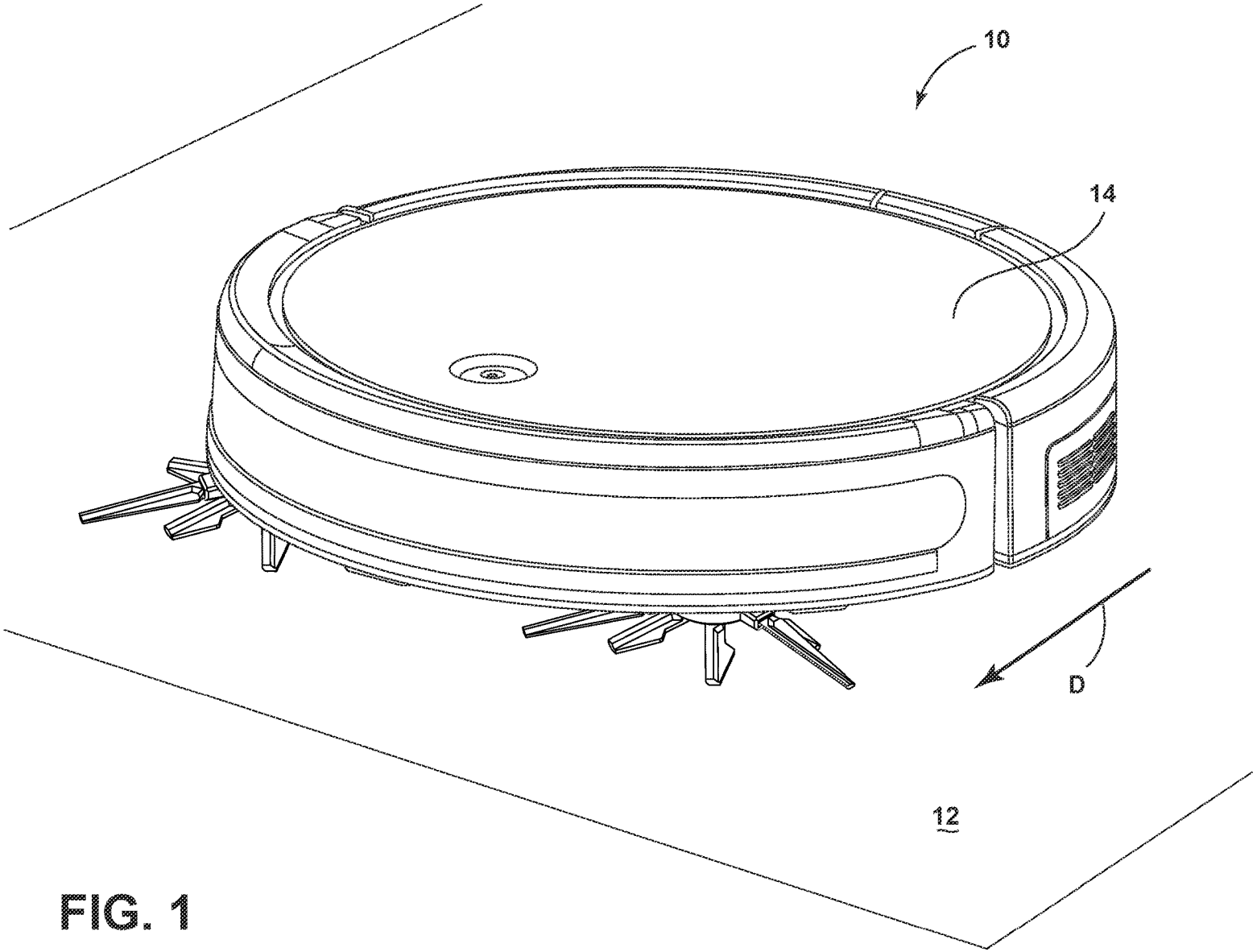
FIG. 1 illustrates a top perspective view of a cleaner in accordance with one non-limiting aspect of the present disclosure.

FIG. 1 illustrates a top perspective view of a cleaner 10 in accordance with one non-limiting aspect of the present disclosure. The cleaner 10 is as described herein for exemplary purposes and may be configured as an autonomous or robotic type of cleaner 10 operable to autonomously clean while being autonomously driven upon a surface 12, which in the case of an autonomous floor cleaner 10 may be a floor surface 12 or other terrain 12. The autonomous functionality of the cleaner 10 may generally correspond with operations the cleaner 10 is capable of performing according to logic, sensors, feedback, and/or computerized controls implemented without corresponding assistance from a human operator. The cleaner 10 may be configured to clean and move around a room or other environment without an operator having to remotely control, physically push, or otherwise personally direct the attendant activities. To this end, the cleaner 10 may include corresponding sensors, controllers, mechanisms, motors, etc. operable to move the cleaner 10 autonomously around an environment while autonomously performing various cleaning tasks.

Figure 2:
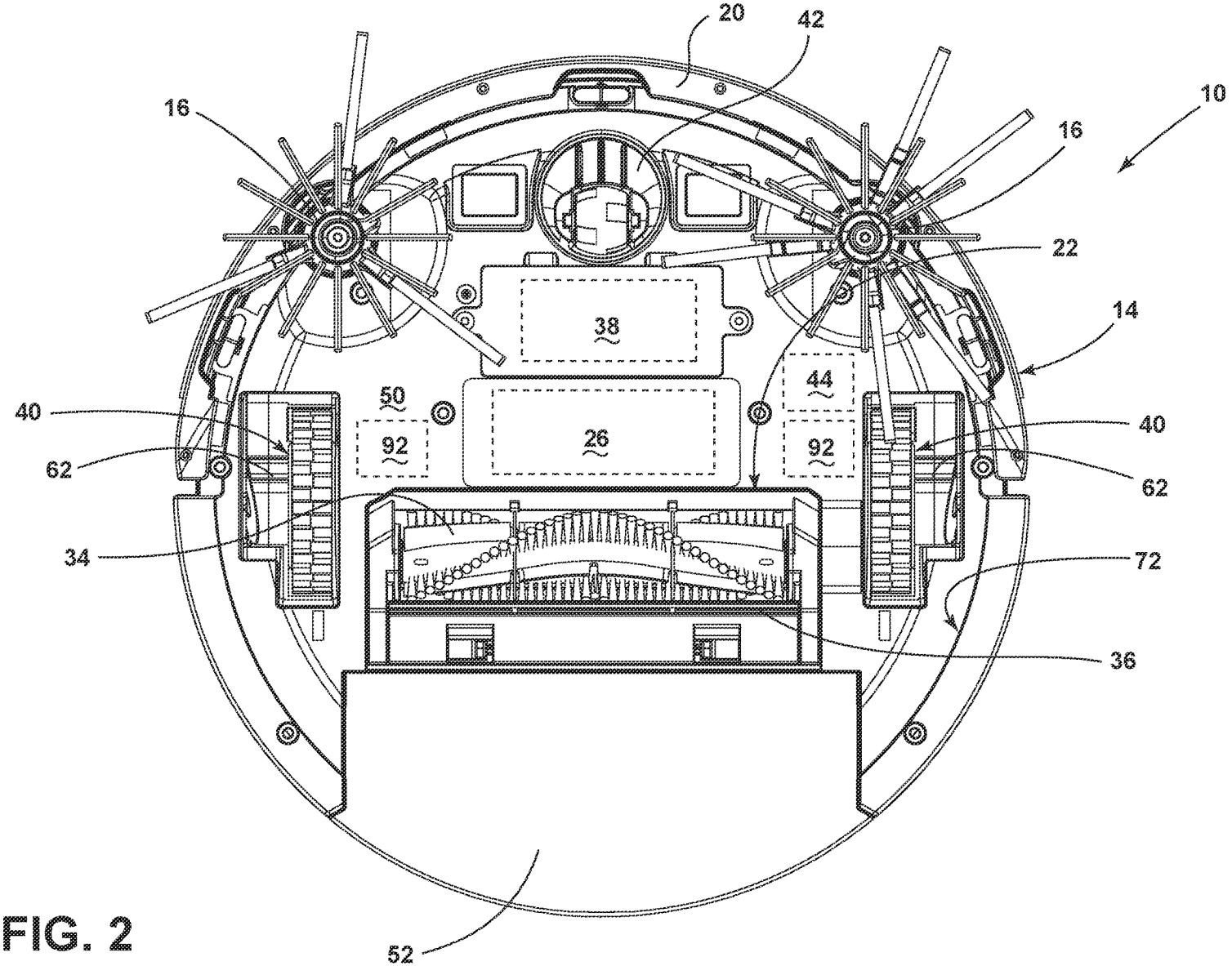
FIG. 2 illustrates a bottom perspective view of the cleaner in accordance with one non-limiting aspect of the present disclosure.

FIG. 2 illustrates a bottom perspective view of the cleaner 10 in accordance with one non-limiting aspect of the present disclosure. The cleaner 10 may include a body 14 configured in accordance with the housing described in U.S. patent application Ser. No. 17/007,450, filed Aug. 31, 2020, entitled Edge Cleaning Brushes for Floor Cleaner, the disclosure of which is hereby incorporated in its entirety by reference. The body 14 may similarly include or otherwise be coupled with a pair of edge cleaning brushes 16, a bumper 20, a suction nozzle 22, a suction source 26, a brushroll 34, a wiper blade 36, an electrical rechargeable power source 38, a pair of wheels 40, a caster 42, a controller 44, and/or the various functional systems described in the incorporated patent application. The controller 44 may facilitate the controls and other operations described herein, which may include a processor associated with the controller 44 executing according to a corresponding plurality of non-transitory instructions stored on a related computer storage medium. These features are highlighted for descriptive purposes as representative of some of the elements commonly employed with an autonomous or robotic infrastructure to facilitate moving cleaners over the floor surface 12. The present disclosure fully contemplates the body 14 having other configurations, including capabilities for using propulsion mechanisms in addition to or in place of the motorized wheels 40.

The illustrated body 14, as one skilled in the art will appreciate, may include the suction nozzle 22 or other cleaning implement disposed on an underside 50 to clean beneath the body 14 as the body 14 is driven across the floor surface 12. A suction force generated with the suction source 26 may be used to collect debris, liquids, and/or a combination thereof though the suction nozzle 22. The positioning of the suction nozzle 22 on the underside 50 may effectively limit the suction nozzle 22 to cleaning portions of the floor surface 12 between the wheels 40 that the body 14 is capable of fitting over in a manner that avoids damaging or scraping the cleaner 10, e.g., that avoids physically dragging part of the cleaner 10 over the obstacle, and/or that avoids dragging the brushroll 34 or a mop (not shown) over carpeting or another sensitive surface where contact may be undesirable. The edge cleaning brushes 16 may be helpful in expanding the cleaning area to portions within the reach thereof, i.e., the brushes 16 may pull debris in towards to the suction nozzle 22 for recovery, which, even with the assistance thereof, may require the suction nozzle 22 to be within a relatively close proximity to the floor surface 12 in order to properly clean items thereon.

Figure 3:
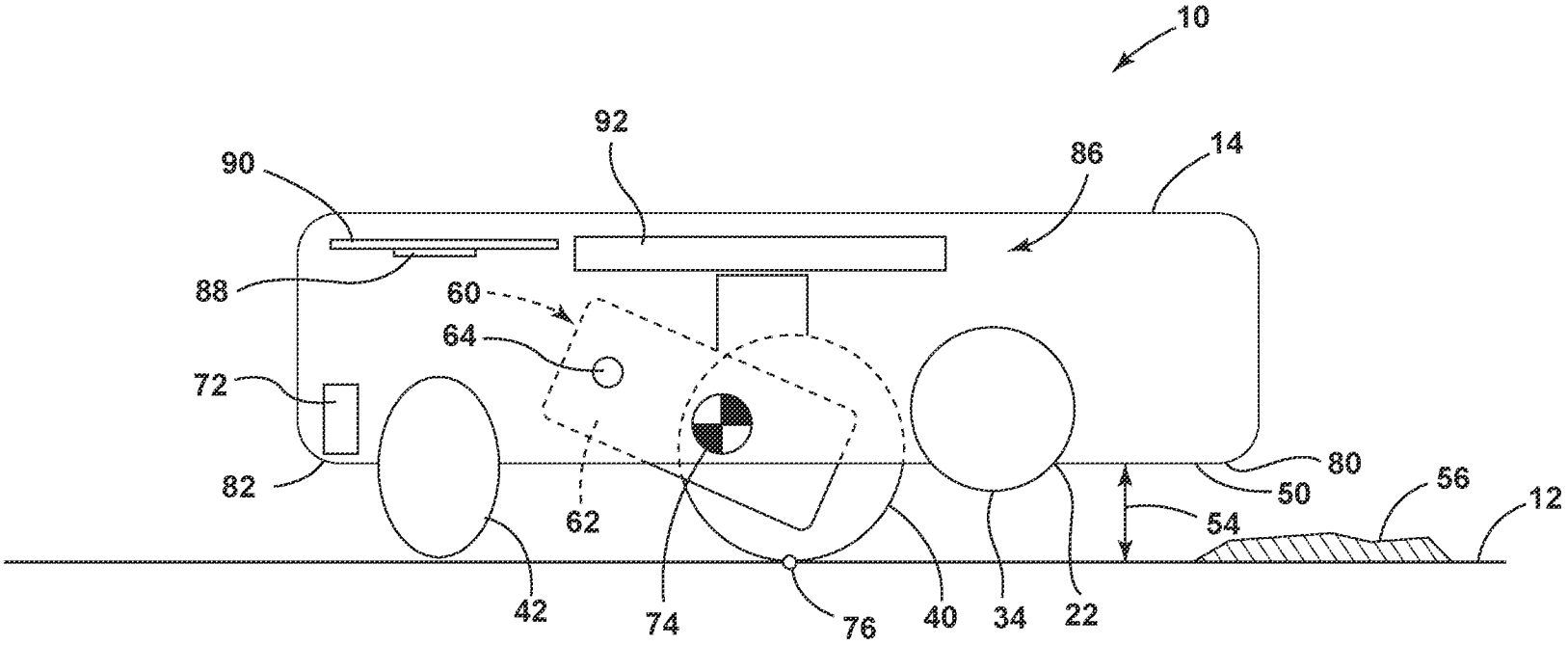
FIG. 3 illustrates a schematic functional view of the cleaner in accordance with one non-limiting aspect of the present disclosure.

FIG. 3 illustrates a schematic functional view of the cleaner 10 in accordance with one non-limiting aspect of the present disclosure where a clearance between the underside 50 and the floor surface 12 is illustrated. When the cleaner 10 is actively cleaning the floor surface 12, i.e., when the suction nozzle 22, the brushroll 34, a mop, or other cleaning implement is positioned in close enough proximity to remove or otherwise properly clean debris from the floor surface 12, the clearance 54 may be required to be no greater than a cleaning height. The cleaning height may correspond with a maximum height for the clearance 54 that the cleaner 10 is able to maintain while retaining sufficient capabilities for cleaning the floor surface 12. The cleaning height is illustrated as being dependent on positioning the suction nozzle 22 and/or the brushroll 34 close enough to the floor surface 12 to be effective, however, the present disclosure fully contemplates the cleaning height varying depending on which cleaning implement is used. The employed cleaning implement, as such, may determine the cleaning height for the cleaner 10 such that the cleaning height may be generally characterized as a desired operational height of the clearance 54 for normally operating a cleaning implement.

An ability of the cleaner 10 to move around portions of the floor surface 12 may be limited by the clearance 54, at least in so far as the clearance 54 may prevent an obstacle 56 of a larger dimension from fitting under the cleaner 10 in a manner that avoids damaging or scraping the underside 50, the suction nozzle, and/or another cleaning implement. While the cleaner 10 may include onboard navigations systems to help with avoiding and moving around such obstacles 56, the avoidance of some obstacles 56 may be insufficient when it may be desirable or required for the cleaner 10 to traverse over an obstacle 56 incapable of fitting thereunder, or if the obstacle 56 can fit at least partially underneath, doing so in a manner that avoids damaging or scraping the cleaner 10. It may be desirable for the cleaner 10 to traverse over the obstacle 56 when the obstacle 56 blocks or otherwise prevents the cleaner 10 from reaching another room or another area desired for cleaning. Even in situations where obstacles 56 may not be present or the obstacle 56 is low, it may be desirable to lift the cleaner 10 above the cleaning height, such as to move over a carpet to another area without dragging a cleaning implement (nozzle, mop, brushroll, etc.) on the carpet.

Figure 4:
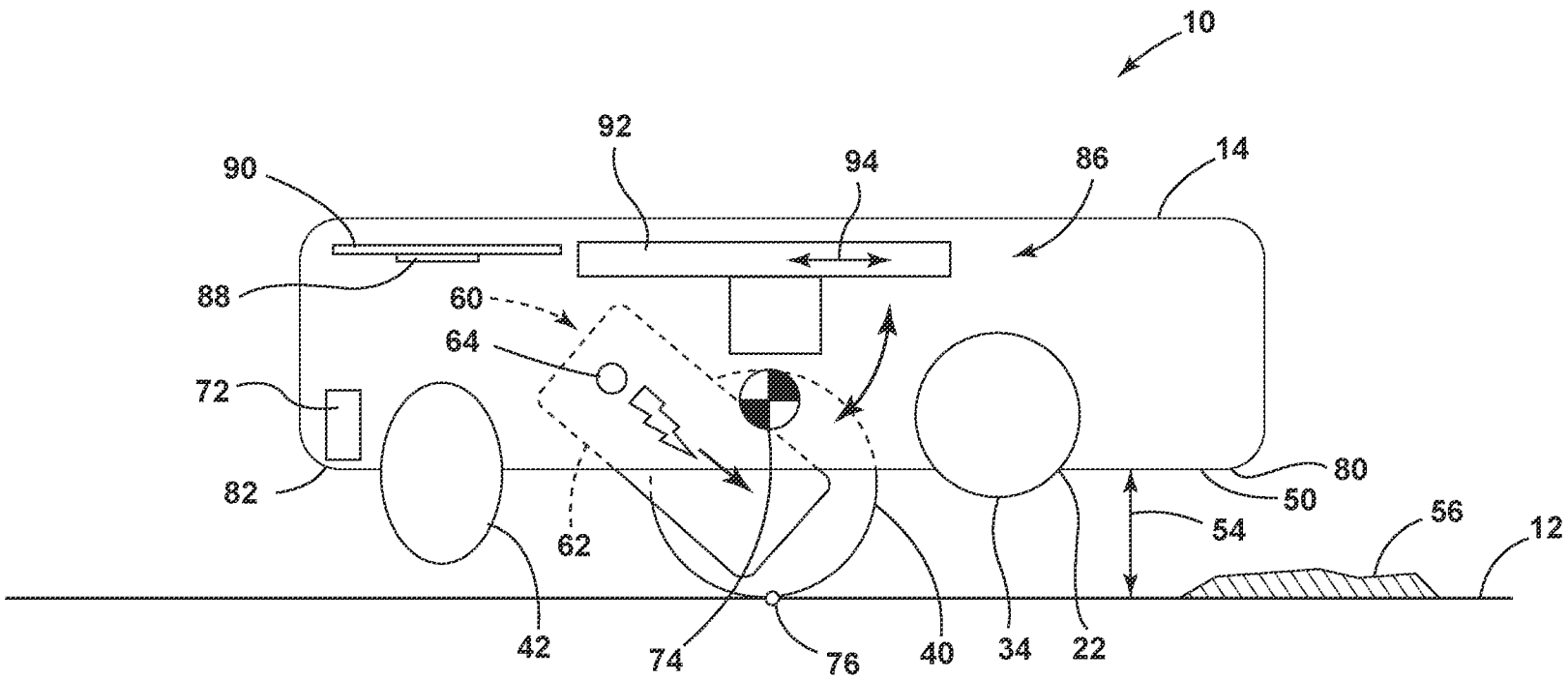
FIG. 4 illustrates a schematic functional view of the cleaner with the actuator extended in accordance with one non-limiting aspect of the present disclosure

One non-limiting aspect of the present disclosure contemplates the cleaner 10 being height adjustable to facilitate navigating over obstacles 56 the cleaner 10 would otherwise be unable to adequately traverse during the cleaning and/or for other purposes, e.g., to avoid dragging a mop on a carpet. FIG. 4 illustrates a schematic functional view of the cleaner 10 in accordance with one non-limiting aspect of the present disclosure where the contemplated height adjustments may correspond with increasing the clearance 54 from the cleaning height to a hover height sufficient to clear the obstacle 56. The hover height may be referred to as height at which the body is raised above the cleaning or normal operating height. One non-limiting aspect of the present disclosure contemplates the cleaner 10 including a plurality of actuators 60 to adjust the height of the cleaner 10, such as by selectively adjusting the clearance 54. The actuators 60 are shown for exemplary purposes as being attached to each of the wheels 40 as the present disclosure fully contemplates other actuators 60 being employed, e.g., retractable rollers (not shown) or other elements capable of extending from the underside to lift the body while the wheels 40 or other motive elements move the cleaner 10.

Figure 6:
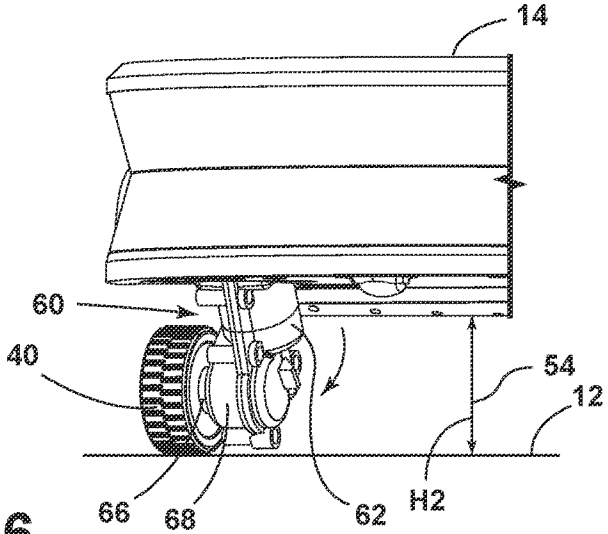
FIG. 6 illustrates a partial perspective view of the cleaner actuator in a partially extended, pivoted position in accordance with one non-limiting aspect of the present disclosure.
Figure 8:
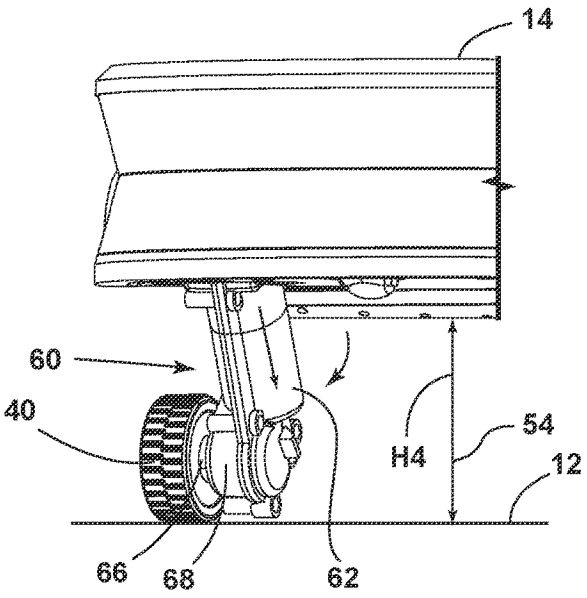
FIG. 8 illustrates a partial perspective view of the cleaner actuator fully extended, pivoted-telescoped position in accordance with one non-limiting aspect of the present disclosure.
Figure 5:
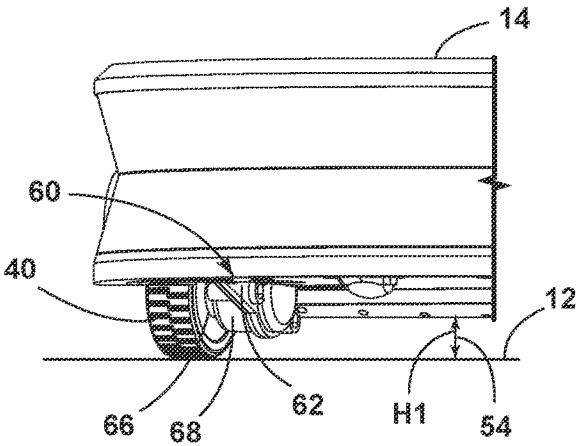
FIG. 5 illustrates a partial perspective view of the cleaner actuator retracted in accordance with one non-limiting aspect of the present disclosure.
Figure 7:
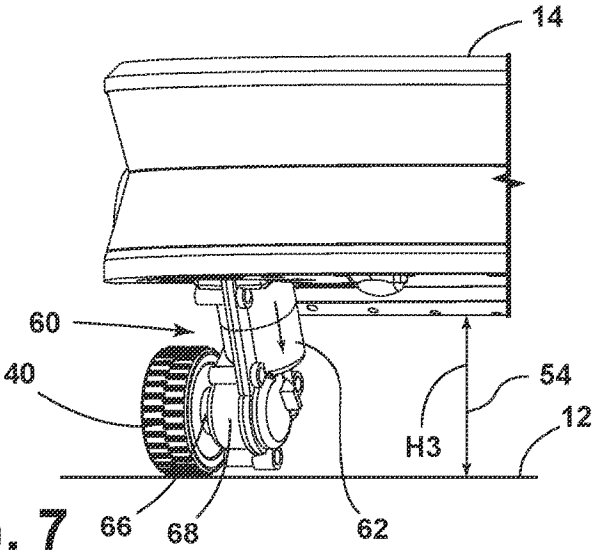
FIG. 7 illustrates a partial perspective view of the cleaner actuator in a partially extended, telescoped position in accordance with one non-limiting aspect of the present disclosure.

While the controller 44 may be configured to selectively adjust actuators 60 to set the clearance 54 to virtually any desirable height, the present disclosure predominately describes the actuators 60 being controllable between at least a first height and a second height, such from the cleaning height to one or more of a pivoted hover height, a telescoped hover height, and a pivoted-telescoped hover height. FIG. 5 illustrates a partial perspective view of the cleaner 10 with the clearance 54 being set to the cleaning height H1 in accordance with one non-limiting aspect of the present disclosure. FIG. 6 illustrates a partial perspective view of the cleaner 10 with the clearance 54 being set to the pivoted hover height H2 in accordance with one non-limiting aspect of the present disclosure. FIG. 7 illustrates a partial perspective view of the cleaner 10 with the clearance 54 being set to the telescoped hover height H3 in accordance with one non-limiting aspect of the present disclosure. FIG. 8 illustrates a partial perspective view of the cleaner 10 with the clearance 54 being set to the pivoted-telescoped hover height H4 in accordance with one non-limiting aspect of the present disclosure.

The actuators 60 may be motorized or pneumatically controlled assemblies having a linkage 62 connecting the wheels 40 to a pivoted coupling or axle 64 included for anchoring to the body 14. The wheels 40 may include a shaft 66, etc. to facilitate rotation, optionally with the assistance of a motor 68 capable of being autonomously controlled with the controller 44 to drive the rotation thereof, such as through a gearbox or other force coupling (not shown). The actuators 60 may be configured to pivot the linkage 62 about the coupling upwardly and downwardly and/or to telescope the linkage 62 inwardly and outwardly. The pivoted hover height H2 may correspond with the linkages 62 being pivoted downwardly from the cleaning height to expand the clearance 54 beyond the cleaning height H1. The telescoped hover height H3 may correspond with the linkages 62 being telescoped outwardly from the cleaning height H1 to expand the clearance 54 beyond the pivoted hover height H2, e.g., the linkage 62 may be comprised of two or more pieces, with one or more of the pieces being moveable within another one or more of the pieces. The pivoted-telescoped hover height H4 may correspond with the linkages 62 being pivoted downwardly and telescoped outwardly from the cleaning height H1 to expand the clearance 54 beyond on the telescoped hover height H3. The actuators 60 may be rotated upwardly and/or telescoped inwardly back to decrease the clearance 54, and optionally further than the cleaning height H1 to additionally shorten the cleaning height.

Referring to FIG. 2, the cleaner 10 may include a distance sensor 72 in communication with the controller 44 for sensing the clearance 54, a distance to the obstacle 56, or another feature thereunder. The controller 44 may utilize measurements made with the distance sensor 72 to facilitate controlling the actuators 60 to adjust the clearance 54 to the desired height, e.g., adjusting the clearance 54 to one of the above described, pivoted, telescoped, and pivoted-telescoped hover heights or to another height, which may optionally depend on a measured height of the obstacle 56 being traversed. The controller 44 may be pre-programmed with dimensional information for the caster 42, the suction nozzle 22, the brushroll 34, or other cleaning implement thereon. This dimensional information may be used in conjunction with the contemplated height adjustments to facilitate determining the clearance 54 needed to surpass the obstacle 56, e.g., to assure a bottom of the caster 42 is above the obstacle 56. The sensor may be configured to determine a width, a depth, or other information for the obstacle 56, which may be used to ascertain the clearance 54 needed to surpass the obstacle 56 and/or combined with movements of the cleaner 10 to assist in positioning the wheels 40, etc. in a manner most likely to move the cleaner 10 over or around the obstacle 56 without contact.

As shown in FIG. 3, the rotatable caster 42 may extend from the underside 50 to facilitate offsetting the body 14 from the floor surface 12 when cleaning. The caster 42 may be configured to freely rotate while the wheels 40 are autonomously driven to move the cleaner 10. One non-limiting aspect of the present disclosure contemplates the caster 42 optionally being driven and/or another motive force being employed such that the wheels 40 may be undriven or non-motorized. A center of gravity 74 of the cleaner 10 may be designed to be forward of a center of balance 76 of the wheels 40 when the clearance 54 is set in the illustrated matter, i.e., to the cleaning height H1. The positioning of the center of gravity 74 forwardly of the center balance 76 may be useful in biasing the caster 42 against the floor surface 12. The caster 42 may periodically bump up or disengage from the floor surface 12 when encountering bumps or other minor protuberances, however, having the center of gravity 74 in such a forward position may effectively maintain the caster 42 against the floor surface 12, and thereby, the cleaner 10 in a stable position with three points of contact with the floor surface 12 via the two wheels 40 and the caster 42.

As shown in FIG. 4, the relative position between the center of gravity 74 and the center of balance 76 may shift in response to the wheels 40 to lifting the body. A single motor (not shown) may be included to drive the linkage 62 in and out, optionally in combination of rotating and sliding movements, that causes the wheels 40 to raise and lower the body 14 while at the same time controlling the center of gravity. The actuators 62 may be correspondingly controlled to maintain the wheels 60 directly under the center of gravity when the body 14 is lifted above the cleaning height H1. The actuators 62 may be configured to keep the wheels 40 directly under the center of gravity when lifted by rotating (along X or Y axis), telescoping (along Z axis), bar linkage lifting (along Y axis), scissor-lifting (along Z axis) or a combination thereof. One non-limiting aspect of the present disclosure contemplates the controller 44 being operable to controllably shift the relative positioning of the body 14 in this manner through corresponding control of the actuators 60 such that the center of gravity 74 can be selectively aligned over top of the wheels 40, i.e., vertically aligned with the center of balance 76.

The actuators 60, for example, may be controlled to facilitate adjusting the center of gravity as desired such that the center of gravity 74 may be forward of the center of balance 76, aligned with the center of balance 76 (self-balance), or rearwardly of the center of balance 76. The alignment of the center of gravity 74 with the center of balance 76 may self-balance the cleaner 10, which may be beneficial to assist in moving the cleaner 10 under some circumstance. The body 14 may be considered as self-balanced when, for example, a forward end 80 and a rearward end 82 have the same clearance 54 and/or are substantially horizontal or level. The self-balancing may be generally characterized as a process for adjusting a tilt or a lie of the body 14, optionally so that the cleaner 10, via the wheels 40, has no more than two points of contact with the floor surface 12 at any one time, instead of the typical three points of contact present when the caster 42 is in contact with the floor surface 12.

Figure 10:
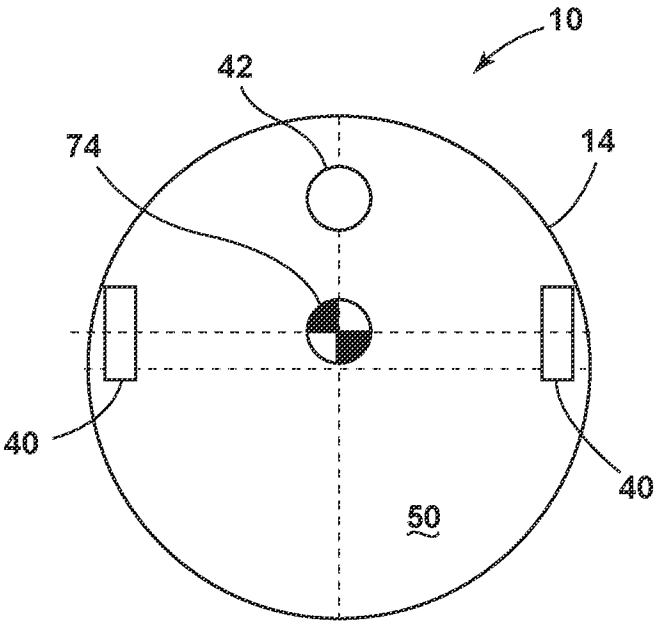
FIG. 10 illustrates a schematic functional view of the cleaner having two points of contact in accordance with one non-limiting aspect of the present disclosure.
Figure 9:
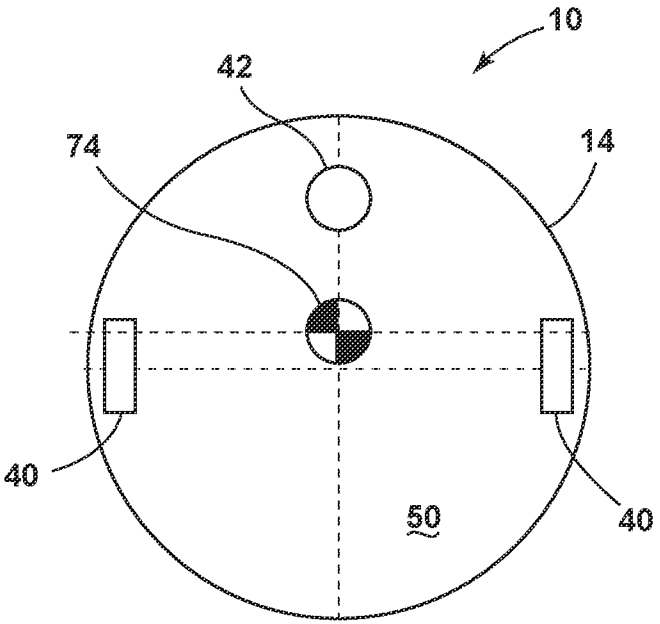
FIG. 9 illustrates a schematic functional view of the cleaner having three points of contact in accordance with one non-limiting aspect of the present disclosure.

FIG. 9 illustrates a schematic functional view of the cleaner 10 having three points of contact in accordance with one non-limiting aspect of the present disclosure. FIG. 10 illustrates a schematic functional view of the cleaner 10 having two points of contact in accordance with one non-limiting aspect of the present disclosure. The cleaner 10 may be selectively controlled between two and three points of contact depending on whether the caster 42 engages (three points of contact) or disengages (two points of contact) the floor surface 12, which may be controllable by moving the center of gravity 74 relative to the center of balance 76. The center of gravity 74 and the center of balance 76 may be the result of design parameters dictated by the components, capabilities, etc. of the cleaner 10, and as such, are merely set forth for illustrative purposes to highlight considerations associated with demonstrating the self-balancing capability of the cleaner 10. A center of mass or a distribution of mass (not shown) may vary depending on the configuration of the cleaner 10 such that the present disclosure fully contemplates more or less relative movement between the center of gravity 74 and the center of balance 76 being needed in order to self-balance the cleaner 10. The center of balance 76 may be affected by the wheels 40 or other components of the cleaner 10 and is mentioned herein in concert with the center of gravity 74 simply as an explanatory principle and without intending to be limiting or otherwise incorporative of specific limitations.

Referring to FIGS. 3 and 4, the cleaner 10 may optionally include a balancing system 86 operable in cooperation with or in place of the actuators 60 to facilitate self-balancing the body. While other componentry may be employed without deviating from the scope and contemplation of the present disclosure, the balancing system 86 is predominantly described with respect to including a level sensor 88 for sensing a level or a tilt of the body 14, an inertia measurement unit (IMU) 90 for detecting acceleration, rotation, etc., and a force influencer 92 for generating and/or manipulating a balancing force 94 (see FIG. 4). The force influencer 92 may be operable in response to instructions from the controller 44 to selectively regulate the balancing force 94, such as by imparting the balancing force 94 fore, aft, laterally, and/or combination thereof to influence balance of the cleaner 10. The force influencer 92, for example, when the cleaner 10 is operating at the cleaning height H1, may be controlled to an inactive state or non-influencing state such that any correspondingly imparted force may be considered as a baseline force or a negligible force with respect to influencing balance of the cleaner 10. The balancing force 94, in contrast, may be considered as a deviation or an intentional change to the baseline force controllable applied to manipulate balancing of the cleaner 10.

The force influencer 92 may be considered to be in an inactive state when the balance force 94 is not be being controllably applied or controllably deviated from the baseline force it may be imparting such that the force influencer 92 may be considered to be in an active state when imparting or otherwise adjusting the balancing force 94 for purposes of inducing a corresponding change in the baseline force. The controller 44 may be operable in response to information derived from the level sensor 88 and/or the IMU 90 to facilitate controlling the actuators 60 and/or the force influencer 92 to achieve the desired balance, which may optionally include making related adjustments as the cleaner 10 autonomously cleans and/or moves around the floor surface 12. The cleaner 10 may be controlled in this manner to self-balance when lifted over an obstacle 56, optionally while simultaneously cleaning the obstacle 56 thereunder, i.e., the brushroll 34 may be positioned to clean a top of the obstacle 56. The cleaner 10 may also be controlled to self-balance when moving to another location without cleaning, such as when moving over a carpeted area to mop a non-carpeted area.

The balancing system 86 may optionally be employed independently of the actuators 60 to shift or otherwise influence balancing or tilting of the body 14, such as to move the center of gravity 74 rearward to lift the caster off of the floor surface 12 in an embodiment of the cleaner 10 without the actuators 60, or when the cleaner 10 includes the actuators 60 and the use thereof is undesirable. The use of the actuators 60, for instance may be undesirable when the balance system 86 may be more efficient or quicker to employ to shift the center of gravity 74, such as to quickly lift the caster 42 over an obstacle 56 without the body 14 having to be lifted. The combined inclusion of the actuators 60 and the balancing system 86 maximizes improvements by providing dual functionality in the sense of the cleaner 10 being capable of lifting itself over objects while balancing to avoid contact with objects thereunder. To this end, the balancing system 86 may be configured to impart the balancing force using various mechanisms, which for exemplary purposes are described herein as corresponding with gyroscopic flywheel 98, a reaction wheel 100, and a movable mass assembly 102.

Figure 11:
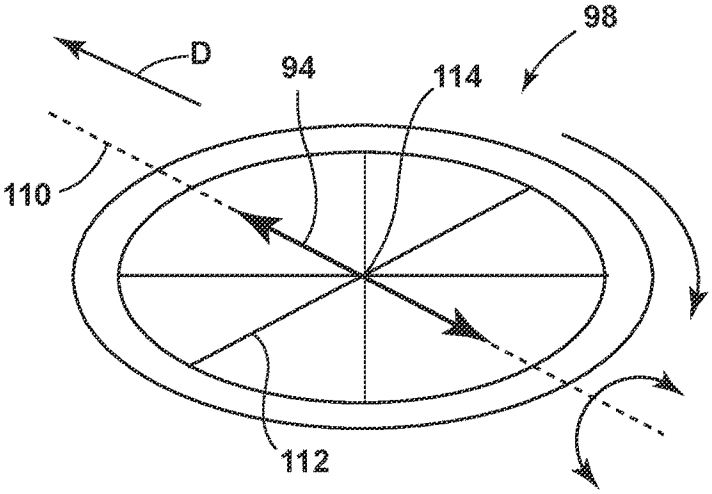
FIG. 11 illustrates a schematic functional view of a gyroscopic flywheel in accordance with one non-limiting aspect of the present disclosure.

FIG. 11 illustrates a schematic functional view of a gyroscopic flywheel 98 in accordance with one non-limiting aspect of the present disclosure. While a single gyroscopic flywheel 98 is shown, the present disclosure fully contemplates more than one of the gyroscopic flywheels 98 may be carried by the body 14 to facilitate imparting a corresponding balancing force 94. The balancing force 94 being imparted may be generated to facilitate a relative adjustment to forces influencing balance of the cleaner 10. The gyroscopic flywheel 98 may do this in the illustrated manner whereby a direction of travel D for the cleaner 10 may correspond with a Y-axis 110 such that an X-axis 112 is perpendicular thereto. The gyroscopic flywheel 98 may be controlled by motors (not shown) or the like to facilitate spinning at a relatively high revolutions per minute (RPM) around a Z-axis 114 while rotating about the Y-axis 110 to correspondingly impart the balancing force 94 as a forward force or a rearward force along the Y-axis 110, i.e., to induce a corresponding fore and aft shift in the relative difference between the center of gravity 74 and the center of balance 76 until the cleaner 10 self-balances.

Figure 12:
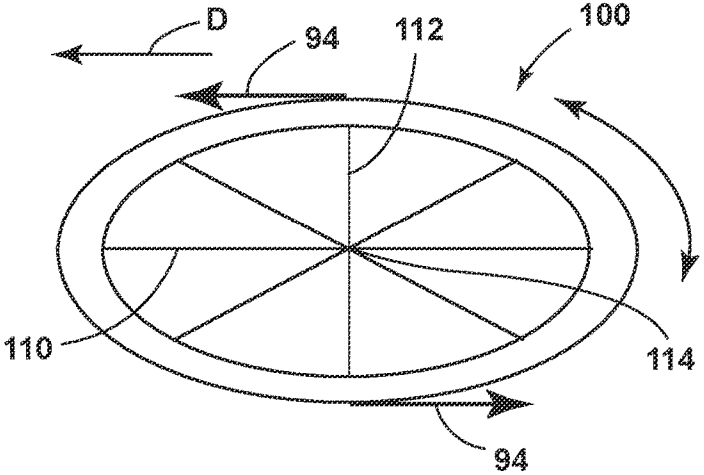
FIG. 12 illustrates a schematic functional view of a reaction wheel in accordance with one non-limiting aspect of the present disclosure.

FIG. 12 illustrates a schematic functional view of a reaction wheel 100 in accordance with one non-limiting aspect of the present disclosure. While a single reaction wheel 100 is shown, the present disclosure fully contemplates more than one of the reaction wheels 100 may be carried by the body 14 to facilitate imparting a corresponding balancing force 94. The balancing force 94 being imparted may be generated to facilitate a relative adjustment to forces influencing balance of the cleaner 10. The reaction wheel 100 does this in the illustrated manner whereby a direction of travel D for the cleaner 10 may correspond with the Y-axis 110 such that the X-axis 112 is perpendicular thereto. The reaction flywheel 100 may be controlled by motors (not shown) or the like to facilitate spinning at a relatively high revolutions per minute (RPM) around the Z-axis 114 to correspondingly impart the balancing force 94 as a forward force or a rearward force along the Y-axis, i.e., to induce a corresponding fore and aft shift in the relative difference between the center of gravity 74 and the center of balance 76 until the cleaner 10 self-balances.

Figure 13:
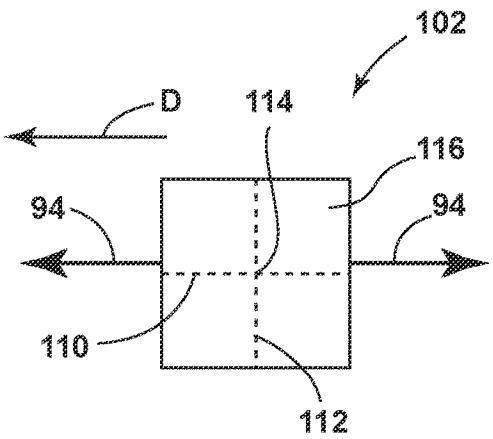
FIG. 13 illustrates a schematic functional view of a movable mass assembly in accordance with one non-limiting aspect of the present disclosure.

FIG. 13 illustrates a schematic functional view of a movable mass assembly 102 in accordance with one non-limiting aspect of the present disclosure. While a single movable mass assembly 102 is shown, the present disclosure fully contemplates more than one of the movable mass assemblies 102 may be carried by the body 14 to facilitate imparting a corresponding balancing force 94. The balancing force 94 being imparted may be generated to facilitate a relative adjustment to forces influencing balance of the cleaner 10. The movable mass assembly 102 may do this in the illustrated manner whereby a direction of travel for the cleaner 10 may correspond with the Y-axis 110 and a movable mass 116 may be controlled by motors (not shown) or the like to be moved along the Y-axis 112 and/or the Z-axis 114 to correspondingly impart the balancing force 94, i.e., to induce a corresponding in the relative difference between the center of gravity 74 and the center of balance 76 until the cleaner 10 self-balances.

The balancing force 94 used to facilitate self-balancing the cleaner 10 may optionally be imparted or controlled according to movement of the cleaner 10. The controller 44 may adjust operations of the force influence 92 depending on whether the cleaner 10 is stationary, turning, and/or moving forward or backward so that the balancing forces 94 can account for forces resulting from the attendant movement. The balancing force 94, at least in this manner, may be a reactionary type of force intended to offset or counteract force changes resulting from movement of the cleaner 10. The controller 44 may optionally direct movement of the cleaner 10 when self-balancing, i.e., instead of reacting to movement, the controller 44 may direct movement, such as by controlling the wheels 40 to accelerate in a particular direction or to repeatedly accelerate between directions. This balance related movement of the wheels 40 may be used to generate forces for fine-tuning alignment of the center of gravity 74 with the center of balance 76. The related movement, however, may be undesirable in some situations where other movements of the cleaner 10 may be desired, i.e., the acceleration or other control of the wheels 40 to facilitate balancing the cleaner 10 may be undesirable when the attendant movement would disrupt the ability of the cleaner 10 to efficiently clean.

The balancing system 86 may optionally be used for other purposes besides self-balancing the cleaner 10, i.e., for other purposes besides aligning the center of gravity 74 with the center of balance 76 or otherwise enabling the body 14 to maintain a level position while having two points of contact with the floor surface 12. The balancing system 86 may, for instance, be used to allow the cleaner 10 to temporarily maintain one point of contact with the floor surface 12, such as by using the balancing forces 94 to heel the body 14 over to one side to a degree sufficient to balance on one of the wheels 40 such that the other wheel 40 and the caster 42 are raised off of the floor surface 12. The balancing system 86 may also be used to assist a cleaning implement with cleaning by providing the implement with more or less pressure relative to the surface 12 being cleaned, such as by causing the body 14 to lean slightly more in one direction than another. Such leaning of the body 14 can, for example, be used to adjust a weight on the caster 42 so that the caster 42 applies less pressure against the floor surface 12 while maintaining contact with the floor surface 12, which may be helpful when traversing sensitive surfaces 12.

The following Clauses provide example configurations of an autonomous air cleaner disclosed herein.

Clause 1. An autonomous floor cleaner comprising: a body; a cleaning implement for cleaning a floor surface; a motorized drive system for autonomously moving the body relative to the floor surface; a plurality of wheels operable with the motorized drive system; and one or more actuators for controllably raising and lowering the body to selectively adjust a clearance between the body and the floor surface.

Clause 2. The autonomous floor cleaner according to clause 1 further comprising a balancing system operable to self-balance the body.

Clause 3. The autonomous floor cleaner according to any of clauses 1-2 wherein the balancing system generates a balancing force to self-balance the body.

Clause 4. The autonomous floor cleaner according to any of clauses 1-3 wherein the balancing system includes a gyroscopic flywheel operable to generate the balancing force.

Clause 5. The autonomous floor cleaner according to any of clauses 1-3 wherein the balancing system includes a reaction wheel operable to generate the balancing force.

Clause 6. The autonomous floor cleaner according to any of clauses 1-3 wherein the balancing system includes moveable mass assembly operable to generate the balancing force.

Clause 7. The autonomous floor cleaner according to any of clauses 1-6 wherein the balancing force adjusts a center of gravity of the body to align with a center of balance for the wheels.

Clause 8. The autonomous floor cleaner according to any of clauses 1-7 wherein the actuators pivot the wheels relative to a pivot coupling included on the body, the clearance decreasing as the wheels pivot upwardly and increasing as the wheels pivot downwardly.

Clause 9. The autonomous floor cleaner according to any of clauses 1-7 wherein the actuators telescope a linkage used to interconnect the wheels with the body, the clearance decreasing as the linkage telescopes inwardly and increasing as the linkage telescopes outwardly.

Clause 10. The autonomous floor cleaner according to any of clauses 1-7 wherein the actuators telescope and pivot a linkage used to interconnect the wheels with the body, the clearance decreasing as the linkage telescopes inwardly and increasing as the linkage telescopes outwardly, the clearance decreasing as the wheels pivot upwardly and increasing as the wheels pivot downwardly.

Clause 11. The autonomous floor cleaner according to any of clauses 1-10 further comprising a controller to autonomously control the motorized drive system and the actuators, wherein the controller adjusts the clearance to a hover height in response to detecting an obstacle protruding above the floor surface, the hover height positioning the body above the obstacle.

Clause 12. The autonomous floor cleaner according to any of clauses 1-11 wherein the controller adjusts the clearance to a cleaning height in response to surpassing the obstacle, the cleaning height being lower than the hover height and below a top of the obstacle.

Clause 13. An autonomous surface cleaner, comprising: a body; a cleaning implement for cleaning a surface; a motorized drive system for autonomously moving the body relative to the surface; one or more actuators for controllably actuating the body between at least a first height and a second height; and a balancing system for generating a balance force to selectively influence a center of gravity for the body.

Clause 14. The autonomous surface cleaner according to clause 13 further comprising a plurality of wheels operable with the motorized drive system and a controller operable to autonomously control the motorized drive system, the actuators, and the balancing system, wherein the controller controls the balancing system to manipulate the balance force such that the center of gravity is forward of the wheels when the body is at the first height and is aligned with the wheels to self-balance the body when the body is at the second height.

Clause 15. The autonomous surface cleaner according to any of clauses 13-14 wherein a rotatable caster extending from an underside of the body forwardly of the wheels engages the surface when the body is at the first height and disengages the surface when the body is at the second height.

Clause 16. An autonomous surface cleaner, comprising: a body; a cleaning implement for cleaning a surface; a motorized drive system for autonomously moving the body relative to the surface; a plurality of wheels operable with the motorized drive system; a balancing system for generating a balance force to selectively influence a center of gravity for the body; and a controller operable to autonomously control the motorized drive system and the balancing system to self-balance the body over the wheels.

Clause 17. The autonomous surface cleaner according to clause 16 further comprising one or more actuators operable to selectively adjust a height of the body between at least a first height and a second height.

Clause 18. The autonomous surface cleaner according to any of clauses 16-17 wherein the controller is operable to control the balancing system such that the center of gravity is forward of the wheels when the body is at the first height and self-balanced over the wheels when the body is as the second height.

Clause 19. The autonomous surface cleaner according to any of clauses 16-18 wherein the body includes a rotatable caster forward of the wheels, the caster contacting the surface when the body is at the first height and raising above the surface when the body is at the second height.

Clause 20. The autonomous surface cleaner according to any of clauses 16-19 wherein the actuators selectively adjust the height from the first height to the second height by pivoting linkages attached to the wheels downwardly and/or telescoping the linkages outwardly relative to the first height.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. "A", "an", "the", "at least one", and "one or more" are used interchangeably to indicate that at least one of the items is present. A plurality of such items may be present unless the context clearly indicates otherwise. All numerical values of parameters (e.g., of quantities or conditions), unless otherwise indicated expressly or clearly in view of the context, including the appended claims, are to be understood as being modified in all instances by the term "about" whether or not "about" actually appears before the numerical value. A component that is "configured to" perform a specified function is capable of performing the specified function without alteration, rather than merely having potential to perform the specified function after further modification. In other words, the described hardware, when expressly configured to perform the specified function, is specifically selected, created, implemented, utilized, programmed, and/or designed for the purpose of performing the specified function.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims. Although several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An autonomous floor cleaner, comprising:

a body;

a cleaning implement configured for cleaning a floor surface;

a motorized drive system configured for autonomously moving the body relative to the floor surface;

a plurality of wheels operable with the motorized drive system;

one or more actuators configured for controllably raising and lowering the body to selectively adjust a clearance between the body and the floor surface; and a balancing system operable to self-balance the body.

2. The autonomous floor cleaner according to claim 1 wherein the balancing system generates a balancing force to self-balance the body.

3. The autonomous floor cleaner according to claim 2 wherein the balancing system includes a gyroscopic flywheel operable to generate the balancing force.

4. The autonomous floor cleaner according to claim 2 wherein the balancing system includes a reaction wheel operable to generate the balancing force.

5. The autonomous floor cleaner according to claim 2 wherein the balancing system includes a moveable mass assembly operable to generate the balancing force.

6. The autonomous floor cleaner according to claim 2 wherein the balancing force adjusts a center of gravity of the body to align with a center of balance for the wheels.

7. The autonomous floor cleaner according to claim 1 wherein the actuators pivot the wheels relative to a pivot coupling included on the body, the clearance decreasing as the wheels pivot upwardly and increasing as the wheels pivot downwardly.

8. The autonomous floor cleaner according to claim 1 wherein the actuators telescope a linkage used to interconnect the wheels with the body, the clearance decreasing as the linkage telescopes inwardly and increasing as the linkage telescopes outwardly.

9. The autonomous floor cleaner according to claim 1 wherein the actuators telescope and pivot a linkage used to interconnect the wheels with the body, the clearance decreasing as the linkage telescopes inwardly and increasing as the linkage telescopes outwardly, the clearance decreasing as the wheels pivot upwardly and increasing as the wheels pivot downwardly.

10. The autonomous floor cleaner according to claim 1 further comprising a controller to autonomously control the motorized drive system and the actuators, wherein the controller adjusts the clearance to a hover height in response to detecting an obstacle protruding above the floor surface, the hover height positioning the body above the obstacle.

11. The autonomous floor cleaner according to claim 10 wherein the controller adjusts the clearance to a cleaning height in response to surpassing the obstacle, the cleaning height being lower than the hover height and below a top of the obstacle.

12. An autonomous surface cleaner, comprising:

a body;

a cleaning implement configured for cleaning a surface;

a motorized drive system configured for autonomously moving the body relative to the surface;

one or more actuators configured for controllably actuating the body between at least a first height and a second height; and a balancing system configured for generating a balance force to selectively influence a center of gravity for the body.

13. The autonomous surface cleaner according to claim 12 further comprising a plurality of wheels operable with the motorized drive system and a controller operable to autonomously control the motorized drive system, the actuators, and the balancing system, wherein the controller controls the balancing system to manipulate the balance force such that the center of gravity is forward of the wheels when the body is at the first height and is aligned with the wheels to self-balance the body when the body is at the second height.

14. The autonomous surface cleaner according to claim 13 wherein a rotatable caster extending from an underside of the body forwardly of the wheels engages the surface when the body is at the first height and disengages the surface when the body is at the second height.

15. An autonomous surface cleaner, comprising:

a body;

a cleaning implement configured for cleaning a surface;

a motorized drive system configured for autonomously moving the body relative to the surface;

a plurality of wheels operable with the motorized drive system;

a balancing system configured for generating a balance force to selectively influence a center of gravity for the body; and a controller operable to autonomously control the motorized drive system and the balancing system to self-balance the body over the wheels.

16. The autonomous surface cleaner according to claim 15 further comprising one or more actuators operable to selectively adjust a height of the body between at least a first height and a second height.

17. The autonomous surface cleaner according to claim 16 wherein the controller is operable to control the balancing system such that the center of gravity is forward of the wheels when the body is at the first height and self-balanced over the wheels when the body is as the second height.

18. The autonomous surface cleaner according to claim 17 wherein the body includes a caster rotatable forward of the wheels, the caster contacting the surface when the body is at the first height and raising above the surface when the body is at the second height.

19. The autonomous surface cleaner according to claim 16 wherein the actuators selectively adjust the height from the first height to the second height by pivoting linkages attached to the wheels downwardly and/or telescoping the linkages outwardly relative to the first height.

20. An autonomous floor cleaner, comprising:

a body;

a cleaning implement configured for cleaning a floor surface;

a motorized drive system configured for autonomously moving the body relative to the floor surface;

a plurality of wheels operable with the motorized drive system; and one or more actuators configured for controllably raising and lowering the body to selectively adjust a clearance between the body and the floor surface;

wherein the actuators telescope a linkage used to interconnect the wheels with the body, the clearance decreasing as the linkage telescopes inwardly and increasing as the linkage telescopes outwardly.

21. An autonomous floor cleaner, comprising:

a body;

a cleaning implement configured for cleaning a floor surface;

a motorized drive system configured for autonomously moving the body relative to the floor surface;

a plurality of wheels operable with the motorized drive system;

one or more actuators configured for controllably raising and lowering the body to selectively adjust a clearance between the body and the floor surface; and a controller to autonomously control the motorized drive system and the actuators, wherein the controller adjusts the clearance to a hover height in response to detecting an obstacle protruding above the floor surface, the hover height positioning the body above the obstacle.

* * * * *